United States Patent [19]

Harkleroad

[11] 4,294,547

[45] Oct. 13, 1981

[54] MORTAR/CONCRETE HAND-MIXING TUB

[76] Inventor: James F. Harkleroad, 9032 - 49th Ave., College Park, Md. 20740

[21] Appl. No.: 59,359

[22] Filed: Jul. 20, 1979

[51] Int. Cl.[3] ..... B01F 13/00; B01F 15/02

[52] U.S. Cl. ..... 366/1; 220/18

[58] Field of Search ..... 366/1, 192, 193, 194, 366/196, 42, 64, 67, 341; 222/556; 294/68, 69 R; 220/1 C, 18, DIG. 6; 119/61; 296/57 R

[56] References Cited

U.S. PATENT DOCUMENTS

| | | | |
|---|---|---|---|
| 1,100,423 | 6/1914 | Dyar | 220/18 |
| 1,461,905 | 7/1923 | Hughes | 296/57 R |
| 2,554,616 | 5/1951 | Daily | 366/1 |

*Primary Examiner*—Edward L. Roberts

*Attorney, Agent, or Firm*—Edwin E. Greigg

[57] ABSTRACT

An improved mortar and concrete hand-mixing tub of the type having a flat bottom wall integrally joined with generally rectangular disposed, upstanding peripheral side walls terminating in an open top, with the basic improvement including a selectively openable and closeable generally planar door panel provided in one of said peripheral side walls to facilitate discharge of hand-mixed mortar from the tub. The discharge door is preferably of the hinged type to open outwardly and downwardly against a wheelbarrow pan, but the door also may be of a laterally slidable gate type.

14 Claims, 7 Drawing Figures

FIG. 1.
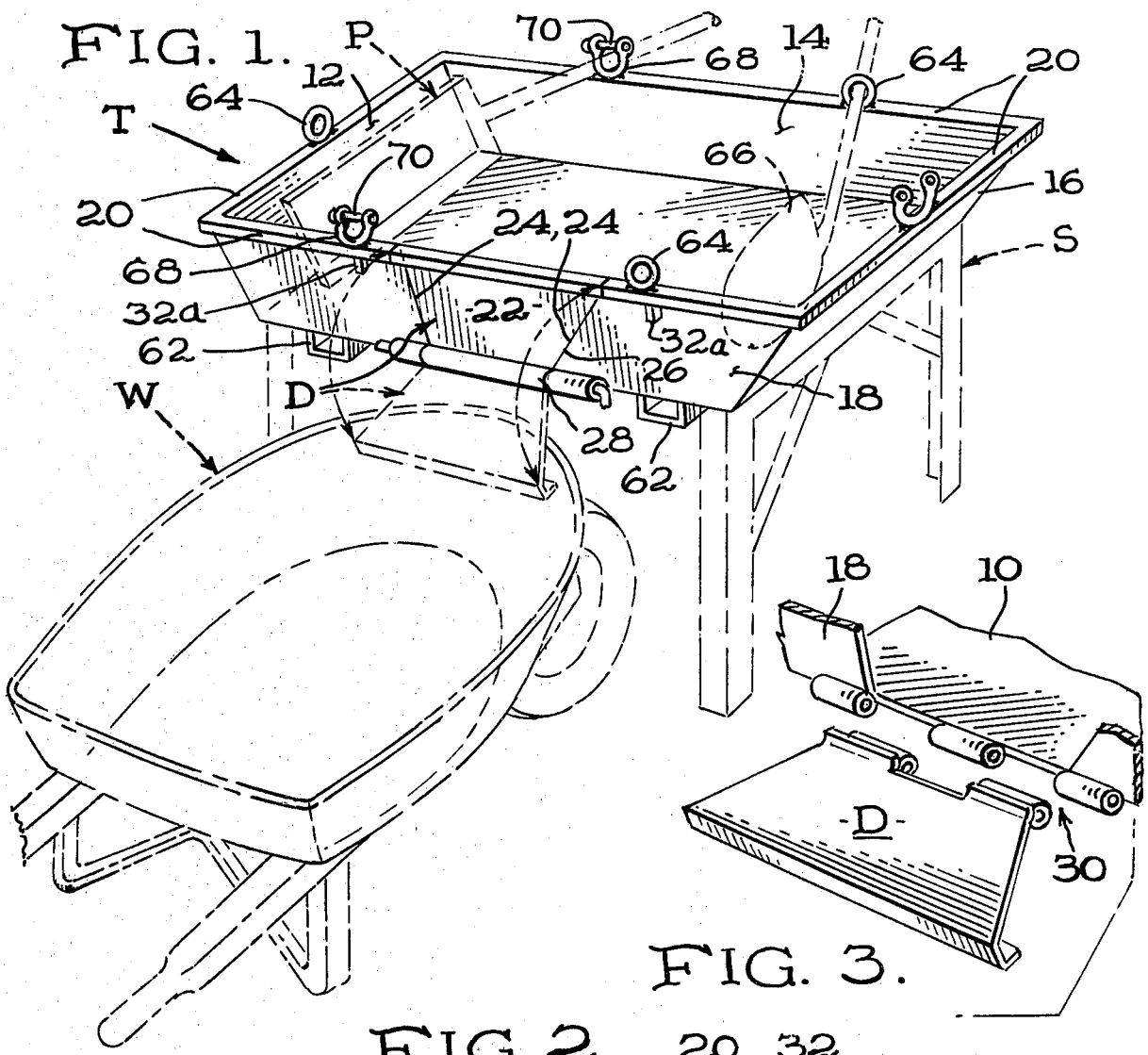
FIG. 3.
FIG. 2.
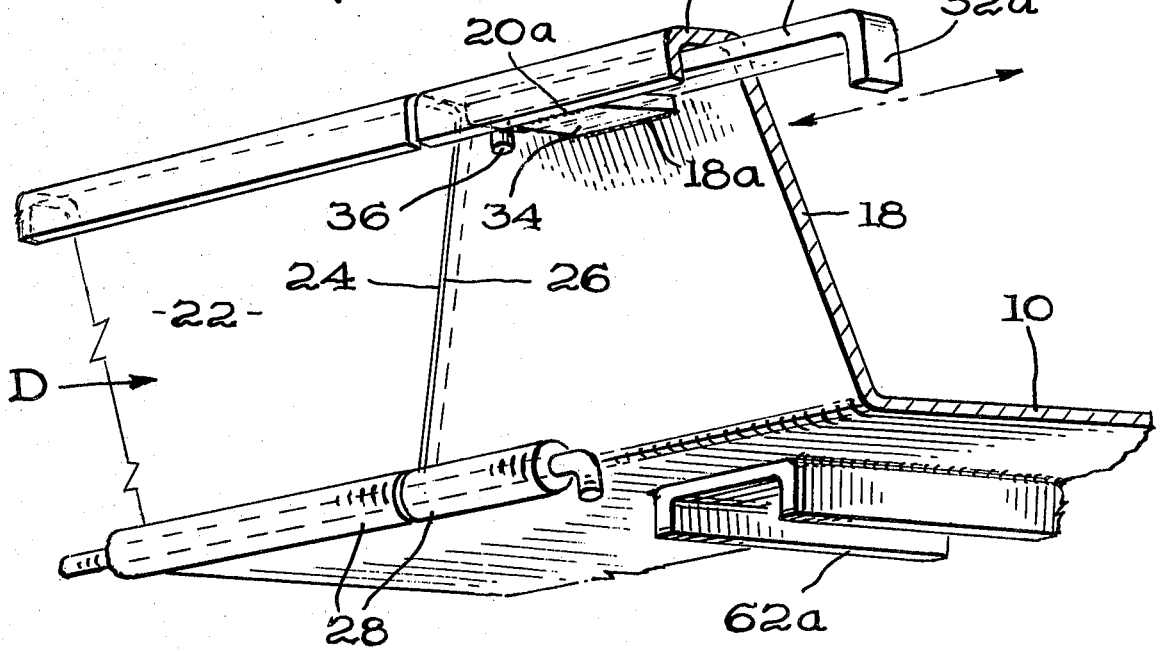

FIG. 4
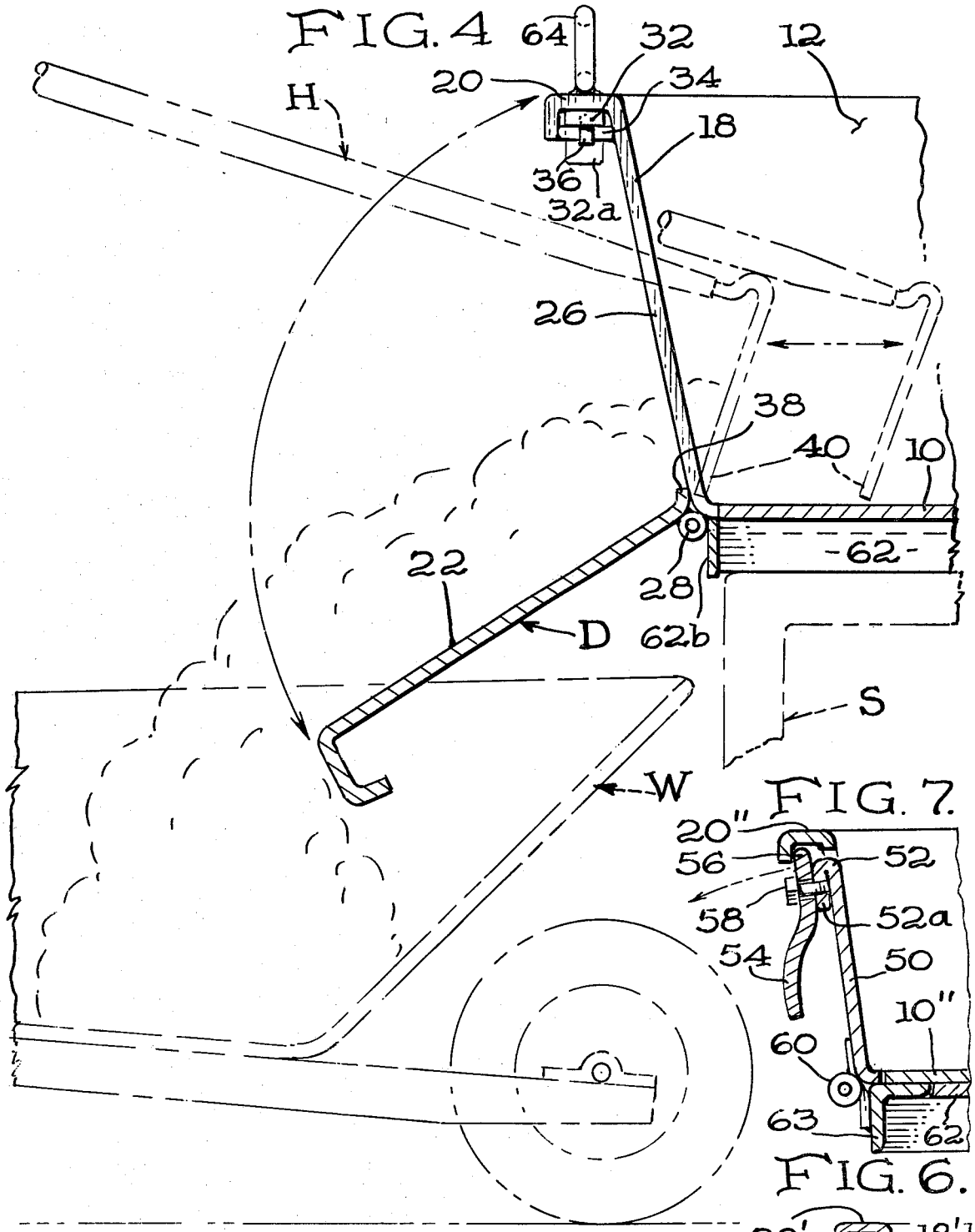
FIG. 7.
FIG. 6.
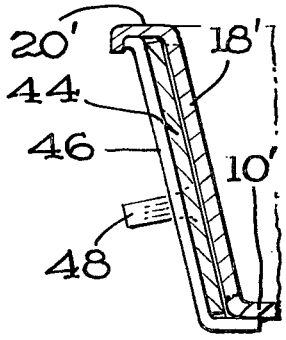
FIG. 5.
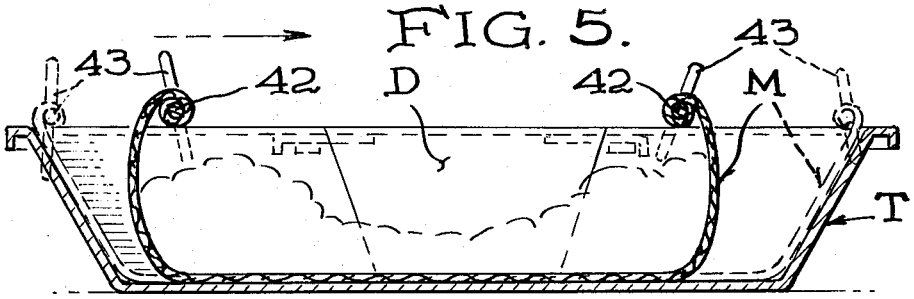

MORTAR/CONCRETE HAND-MIXING TUB

BACKGROUND OF THE INVENTION

Heretofore, the more conventional types of hand-mixing mortar tubs have been of the type which comprise a flat, rectangular bottom floor or wall integrally joined along its edges with four generally rectangularly-disposed, upstanding, completely doorless, peripheral side walls. These side walls terminate in an open top having a flanged or bevel-edged, with one pair of opposed side walls designated as end walls which are oppositely and outwardly inclined at about 45°–60° relative to the bottom/floor wall, in a manner well known to those versed in the masonry art.

The conventional practice has been to use such a tub by setting it on a fairly level area of ground or propped upon a series of horizontally leveled cinder blocks or other supports. The mortar or concrete ingredients of sand, powdered cement, (and lime when needed) are shoveled and/or dumped into the tub, pre-mixed in a generally dry state with a mixing hoe or shovel and then wet-mixed by adding the requisite amount of water. Thereafter the wet-mixed mortar or concrete had to be shoveled or hoed out of the tub. When hoeing the mortar/concrete it has been necessary heretofore to hoe-pull the mixture up and over the inclined end wall until it falls into the adjacent wheelbarrow or other receptable, a practice which involves considerable exertional force and work on the part of the laborer doing this mixing while tending his mason.

The present invention, while relating generally to mortar/concrete hand-mixing tubs of the above-mentioned type, more specifically relates to a markedly improved tub of this type wherein the improvement comprises the provision of a selectively openable and closeable generally planar door panel in one of the peripheral side walls to facilitate easier discharge of hand-mixed wet mortar or concrete into a wheelbarrow or other suitable receptacle.

OBJECTS OF THE INVENTION

In view of the ever-continuing demand for masonry construction of building and the extensive ongoing use of basic hand-mixing mortar tubs of the aforementioned more conventional type, necessarily accompanied by the attendant greater degree of heavy exertional labor to empty the wet-mixed mortar/concrete, it is a principal object of this invention to provide an improved mixing tub having a relatively inexpensive, simple hinged discharge door means embodied into one of the tubs' sidewalls or end walls.

Another object of the invention is to provide an improved mixing tub of the aforestated door-type in which the door is selectively retained in the closed condition by readily operable retaining slide bolt means provided at one or both sides of the door in cooperation with an outwardly and downwardly flanged top edge of the open tub.

Still another object is to provide a tub of the aforestated improved character wherein the discharge door is formed in such a manner to embody therewith along its lower hinge edge an angular terminal edge which is generally coplanar with the tub bottom or floor when the door is in the closed condition, but which edge projects upwardly slightly above the said floor when the door is in the open and downwardly inclined position, whereby said upwardly projecting edge acts as a hoe-stop for engagement by the operative working edge of a hoe tool used to help discharge the mortar from the tub.

A further object of the invention is to provide a plurality of dual-purpose ring-members affixed to the flanged top edge of the tub at predetermined spaced-apart strategic locations, the dual purposes of which include (1) means for attaching cable-lifting means to facilitate loading and unloading of the tub onto and from a truck bed, and (2) to serve as an oar-lock type apparatus adaptable to receive there through the free ends of long-handled paddle or shovel means to aid in moving wet-mixed mortar therein toward the discharge door.

Still a further object of the invention is to provide a tub of the aforestated improved character wherein the discharge door may be of a hinged or slidable character and disposed within any of the four side walls, or alternatively may comprise a full end wall member hinged to be selectively fully opened.

Yet a further object is to provide an improved tub according to the aforestated objectives further including in combination therewith flexible tub liner membrane and means for drawing said liner and any mortar content thereon toward the discharge door or panel means of said tub.

These and other objects and advantages will become more evident and their achievement more apparent from reference to following described illustrative drawing figures and to the following more detailed specifications.

BRIEF DESCRIPTION OF THE DRAWING FIGURES

FIG. 1 is a perspective view of one preferred embodiment of the improved mortar-mixing tub of this invention, shown in conjunction with a suitable support stand and wheelbarrow shown in phantom outline;

FIG. 2 is a fragmentary perspective view on an enlarged scale showing part of the hinge detail and slide bolt means for retaining the discharge door in a closed position;

FIG. 3 is another fragmentary perspective view of the discharge door having a slightly modified form of hinge means, and shown in unassembled relation to a related portion of the tub;

FIG. 4 is an enlarged cross-sectional view taken through the opened discharge door and a fragmentary associated portion of the mixing tub or box;

FIG. 5 is a longitudinal cross-sectional view through an improved mortar tub of this invention having in combination therewith a flexible tub-liner shown in the process of drawing the mixed mortar toward the center-disposed discharge door;

FIG. 6 is a fragmentary cross-sectional detail view of a modified slidable form of discharge door; and FIG. 7 is a further fragmentary cross-sectional view of a tub having a modified door, top edge and locking arrangement.

DESCRIPTION OF PREFERRED EMBODIMENTS OF THE INVENTION

The invention will now be described in reference to a few preferred embodiments, wherein like identifying reference characters and numerals will designate corresponding parts throughout the several illustrative figures.

In FIG. 1, briefly the improved tub T is shown supported upon a stand S. The tub T is provided with a hinged discharge door D which also is shown by broken lines in its open condition downwardly resting on the forward edge of a wheelbarrow W in a manner to facilitate easier discharge of the mortar or concrete content of the tub into the wheelbarrow. Also shown in broken outline are long handled shovel and/or paddle means P which may be selectively used in the manner depicted, if so desired, to help move the mortar contents toward the medially disposed discharge door D.

More specifically, the tub T comprises a rectangular bottom wall or floor member 10 which is joined along its peripheral edges with four corresponding generally rectangularly disposed upstanding peripheral side walls 12, 14, 16 and 18. One pair of the opposed side walls, i.e. walls 12 and 16 are preferably oppositely outwardly inclined at an angle of approximately 45°–60° C. relative to bottom floor wall. These walls 12, 16 constitute the sloping end walls in a manner customary for mortar tubs/boxes. The other opposed walls 14, 18 constitute the more upright side walls and may be either at right angles to the floor or at a slightly outwardly sloping disposition, shown in an exaggerated manner in FIG. 4.

While it is understood that the door D may be formed in either an end or a side wall, or both if so desired, for illustrative purposes the door D is shown formed in conjunction with a medial part of side wall 18.

The side walls are integrally interjoined at their respectively abutting corners and the upper edges thereof terminate in a continuous horizontally outwardly and slightly downwardly flanged edge 20 defining the open top of the tub.

The door D is comprised of a generally planar panel 22 preferably but not necessarily having oppositely inclined side edges 24, 24, which are adapted to complementally fit between correspondingly inclined intermediate edges, 26, 26 which basically define the door opening. The door is preferably hingedly attached to the floor of the tub by any suitable hinge means such as shown at 28 (FIGS. 1 and 4) or modified hinge means 30 (FIG. 3).

While a variety of door closure locking or retaining means may be utilized, one preferred means includes a slide bolt member 32 constructed of a size to complementally fit under and within the outwardly and downwardly flanged top edge 20 of the tub, as better seen in FIG. 2. A retaining and supporting member 34 is preferably welded to both the lower edge 20*a* (FIG. 2) and to an opposed portion 18*a* of the side wall 18 in a manner to slidably support and retain slide bolt 32 in its operative position beneath flanged edge 20. After insertion of the L-shaped bolt 32 into the opening defined between the support member 34 and edge 20, a retaining pin 36 is removably affixed into the underside end thereof opposite from the angled end 32*a*. It is apparent that in 36 serves to preclude inadvertant complete removal of the slide bolt and to limit its retractive movement after it clears the lateral edge 24 of the discharge door D. While only one slide bolt is shown in conjunction with one side edge of the door D, it is apparent that if desired, two such bolts 32 can be used, one at each lateral side of the door, or a single further elongated bolt may be used having a length to extend beyond and to supportingly retain both lateral sides of the door in a fixed closed condition.

A preferred further feature of the door D is the formation therewith in the area of the hinge an angular short lower edge designated 38. Edge 38 is designed to be essentially coplanar with the floor 10 when the door is in the closed condition, but which edge 38 projects upwardly slightly above the floor when the door is in the open and downwardly inclined position, as shown in FIG. 4. The purpose of this feature 38 is to provide a potential stop member for engagement by the working edge 40 of a hoe tool H when such a tool is used to help discharge the mixed mortar or concrete from the tub.

MODIFIED EMBODIMENTS

Reference will next be made to FIG. 5 which illustrates a flexible tub liner or membrane M to be selectively used in conjunction with the improved tub of this invention disclosure. The membrane M is of a length to enable it to overlay the ends of the tub, which ends either may be manually gripped directly, or more preferably may be attached to preferably cylindrical cross members 42, 42. The latter members are adapted to rest upon opposite top side edges of the tub, whereby said membrane then is indirectly manually pulled together or the ends rolled up toward each other, as by key handles 43, 43 or by other suitable operative means. It is understood that the arrangement may be modified to roll the membrane only from one end toward the other opposite end in the event the discharge door is disposed more toward one end, or within an end panel, or which door may comprise essentially the complete end wall member of the tub or box T.

The invention hereof also contemplates another preferred form of the basically door-improved tub, by use of a laterally slidable door panel, which is shown at 44 in FIG. 6. Door 44 is of a length greater than the discharge opening and is adapted to be slidably retained by strap members 46 in adjacent relationship to side wall panel 18', which is shown in relation to top edge 20' and floor member 10'. A suitable laterally projecting handle 48 is preferably affixed to the door 44 to facilitate the slidable movement thereof. Strap members 46 are preferably welded or otherwise affixed at the upper end beneath flange 20', and to the bottom of floor member 10', as shown in FIG. 6. In this embodiment, the upper edge 20' is continuous and need not be interrupted, thereby providing increased rigidity to side wall portions 18' at each side of the door opening.

A still further contemplated modification is depicted by the fragmentary cross-sectional detail in FIG. 7. In this embodiment, door 50 is constructed and hingedly attached very similar to the first-described embodiment, but differs therefrom as follows. Door 50 has an uppermost edge 52 which terminates short of or below a continuous top edge 20'', and which edge preferably includes a portion folded over on itself as at 52*a*. The top edge 52 also terminates in a manner and disposed such that it can open freely outwardly beneath the depending lip portion of edge 20'' when in the unlocked condition being readied for discharge of the mortar contents. While various modes of locking means or other suitable retainers may be used, one preferred exemplary latch means comprises a pivotally mounted handle 54. The handle 54 includes a retaining or locking detent end 56 adapted to engage beneath the depending outer portion of top edge 20'' to operatively lock the door in its closed condition. By rotating the handle about its pivot pin 58, detent end 56 moves clear of the depending top edge 20'' and the door is free to be opened outwardly and downwardly about its hinge means 60, to facilitate easier emptying of the mortar content of the tub. Door 50 may also constitute one full end wall.

Some additional optional features for the improved tub hereof will now be described. More particularly where the tub T is made of relatively thin sheet material (preferably metal), two or more transverse combined channel-shaped reenforcing and support/lifting members 62, 62 are preferably integrated as by welding with the bottom or floor member 10, as shown in FIG. 1. In FIG. 2, the channel shaped members are shown in a modified, inverted disposition and are designated 62*a*. The function thereof is to provide not only the transverse additional rigidity to the tub and floor, but also are adapted to receive therein a pair of laterally spaced lifting tines of a mechanized lifting fork machine. This enables the tub to be more readily lifted off from or onto a transporting truck bed, and/or to be otherwise moved by the well known fork lifting mechanisms.

Relative to the latter feature, some further contemplated refinements are the provision of various stop means for limiting the insertion of the tines within the channel members 62, 62*a*. In the simplest form, as shown in FIG. 4, end plates 62*b* are suitably affixed, as by welding, to the ends of channel members 62. By limiting the extent of tine insertion, full operation is assured of the mortar box and its discharge door during such times as may be necessary to use the same while being supported on tines, thus precluding overinsertion of the tines from interfering with and preventing full opening of the discharge door.

In FIG. 7, a variation of the tine stop is the use of an angle iron member 63 welded along the full length or width of the floor 10", and which angle members may be affixed essentially completely around the floor periphery to add increased strength and rigidity. This is preferred more particularly along the hinge line, and also in tubs/boxes where lighter gauge sheet material has been used.

Another mode of lifting the tub is provided by inclusion of two, three or four preferably ring-like shaped brackets 64 affixed to the upper edge 20. These ring-like brackets are adaptable for interchangeable use with a hoisting cable means (not shown) and with long handled paddle means P or shovels 66 (FIG. 1), the shovel or paddle means being useful to aid in moving the wet-mixed mortar content toward the discharge door. Modifications of the ring-shaped brackets 64 are alternatively provided by the more generally U-shaped brackets 68, 68 (FIG. 1) which are adapted to receive the handle portion of paddles P and to perform similar to oarlocks on a rowboat, when the shovels or paddles P are manipulated exteriorly of the tub to help move the mortar contents toward the discharge door area. The U-shape brackets 68 may be left either open at their top portions, or may alternatively be apertured to receive a selectively removable retaining or hold-down pin 70.

From the foregoing detailed description, it is apparent that a markedly improved mortar-mixing tub has been invented which achieves all of the stated objectives and affords the aforementioned advantages reviewed in the beginning portion of this application.

Various other changes and further alterations may be made in the details of construction, such as providing reenforcing framework around and/or in conjunction with the discharge door and door opening. It is apparent that these and others, including providing sub-combination door kits as accessories for replacement parts or to enable "do it yourself" craftsmen to modify their existing doorless mortar boxes, may be made without departing from the spirit and scope of the invention as defined in the appended claims.

What is claimed is:

1. In a concrete or mortar mixing tub or box of the type having a flat bottom wall integrally joined with peripheral side walls upstanding therefrom and terminating in an upper edge forming an open top, the improvement comprising a selectively openable planar panel constituting a mortar discharge door formed in conjunction with a door opening provided in one of said peripheral side walls, said door panel being of lesser length than said side wall panel with which it is associated, and support and retaining means operatively connected with said side wall and said door to facilitate its selective opening and closing.

2. The improved mortar mixing tub as defined in claim 1, wherein said door has hinge means thereon connecting a lower edge of said door and complemental hinge means on adjacent portions of said mortar tub.

3. The improved mortar mixing tub as defined in claim 1, wherein said discharge door and door opening have complemental oppositely tapered lateral side edges converging from the open upper top toward the bottom wall thereof.

4. The improved tub as defined in claim 1 wherein said discharge opening and discharge door are generally centered in one of said side walls between opposite ends of said wall.

5. The improved mortar mixing tub as defined in claim 3 wherein said peripheral side wall in which said discharge door is formed and said door are disposed in essentially coplanar relation when said door is in a closed position.

6. The improved mortar mixing tub as defined in claim 1, further including locking means for locking said discharge door in a closed condition generally coplanar with the upstanding side wall with which it is associated.

7. The improved tub as defined in claim 6 wherein said upper edges of said peripheral side walls terminate in a relatively shallow outwardly and downwardly flanged marginal edge, and said locking means includes slide bolt means mounted in operative cooperation with and beneath said flanged marginal edge on at least one lateral side of said discharge door.

8. The improved tub as defined in claim 1, further including in combination therewith a long-handled paddle and at least one generally U-shaped fulcrum bracket connected to the open top edge of said tub, said bracket adapted to removably and selectively receive therein an intermediate portion of said paddle handle to enable said paddle to be manually operated to move mixed mortar content of the tub toward said discharge door.

9. the improved tub as defined in claim 1, further including at least a pair of ring-shaped brackets, with one each affixed to a pair of opposed upper edges of said open tub, said rings adaptable for interchangeable use with either long handled paddle means to aid in moving the mortar content toward said discharge door, and for use as cable-attaching hoisting or lifting means to facilitate lifting said tub for transporting same from one site to another.

10. The improved tub as defined in claim 1, further including a pair of laterally spaced lifting and support members attached to the underside of said bottom wall, said members including channel-like members adaptable to receive lifting tines of a mechanized lifting fork machine.

11. The improved tub as defined in claim 1, wherein said discharge door includes a lowermost longitudinal edge, and wherein said means operatively connected with said side wall and said door are so disposed that when said door is in the open discharging condition, the said door's lowermost longitudinal edge projects slightly above the surface of said bottom wall and is adapted to act as a stop against which a working edge of a mixing hoe tool is engageable when used to aid in the discharging of mixed mortar from said tub through said door.

12. The improved tub as defined in claim 1 wherein said discharge door panel slidably overlays and is substantially longer than a discharge opening formed in one side wall with which it is associated, and said means for operatively opening and closing said door include means for holding said door in closely slidable engagement with said associated side wall.

13. The improved tub as defined in claim 1, further including in combination therewith a flexible tub liner and means for drawing said liner and any mixed mortar content of said tub toward said discharge door.

14. A concrete or mortar mixing box of the type having a flat bottom wall having a plane integrally joined with peripheral side walls upstanding therefrom and terminating in an upper edge forming an open top, the improvement comprising in combination therewith support and retaining means for mounting one of said peripheral side walls for selective opening a limited portion thereof and closing the same about a horizontal axis lying in the plane of the said flat bottom wall, said selectively openable and closeable limited side wall portion constituting discharge door means through which the box contents may be selectively discharged when in the open condition.

* * * * *